US005439583A

United States Patent [19]

Robinson et al.

[11] Patent Number: 5,439,583

[45] **Date of Patent: * Aug. 8, 1995**

[54] SULFUR REMOVAL SYSTEMS FOR PROTECTION OF REFORMING CRYSTALS

[75] Inventors: Richard C. Robinson, San Rafael; Robert L. Jacobson, Vallejo; Harris E. Kluksdahl, San Rafael; William A. Blanton, Woodacre; Dennis L. Holtermann, Crockett; Leslie A. Field, Portola Valley, all of Calif.

[73] Assignee: Chevron Research and Technology Company, San Francisco, Calif.

[ * ] Notice: The portion of the term of this patent subsequent to May 3, 2005 has been disclaimed.

[21] Appl. No.: 243

[22] Filed: Jan. 4, 1993

Related U.S. Application Data

[63] Continuation of Ser. No. 357,297, May 26, 1989, abandoned, which is a continuation-in-part of Ser. No. 166,588, Mar. 10, 1988, Pat. No. 4,925,549, which is a continuation of Ser. No. 667,505, Oct. 31, 1984, Pat. No. 4,741,819.

[51] Int. Cl.[6] ..... C01G 35/06

[52] U.S. Cl. ..... 208/62; 208/65; 208/66; 208/99; 208/89; 208/212

[58] Field of Search ..... 208/91, 99, 89, 65, 208/66, 62, 212

[56] References Cited

U.S. PATENT DOCUMENTS

| | | | |
|---|---|---|---|
| 2,856,347 | 10/1958 | Seelig et al. | 208/89 |
| 3,522,093 | 7/1970 | Woolmann | 134/22 |
| 3,627,653 | 12/1971 | Cricco | 204/141 |
| 3,732,123 | 5/1973 | Stolfa et al. | 134/19 |
| 3,806,443 | 4/1974 | Maziuk | 208/60 |
| 3,818,975 | 6/1974 | Tokumitsu et al. | 165/1 |
| 3,898,153 | 8/1975 | Louder et al. | 208/89 |
| 3,996,335 | 12/1976 | Wolk et al. | 432/210 |
| 4,010,093 | 3/1977 | Maziuk | 208/65 |
| 4,127,470 | 11/1978 | Baird, Jr. et al. | 208/58 |
| 4,141,816 | 2/1979 | Crowley et al. | 208/107 |
| 4,196,050 | 4/1980 | Takahashi et al. | 196/122 |
| 4,203,825 | 5/1980 | Kmak et al. | 208/48 |
| 4,224,108 | 9/1980 | Takahashi et al. | 196/122 |
| 4,243,633 | 1/1981 | Hozuma e tal. | 422/129 |
| 4,276,185 | 6/1981 | Martin | 252/87 |
| 4,289,639 | 9/1981 | Buske | 252/87 |
| 4,313,820 | 2/1982 | Farha, Jr. et al. | 208/213 |
| 4,348,271 | 9/1982 | Swan | 208/89 |
| 4,376,694 | 3/1983 | Lohr et al. | 208/48 |
| 4,510,041 | 4/1985 | Miller et al. | 208/48 |
| 4,511,457 | 4/1985 | Miller | 208/48 |
| 4,529,500 | 7/1985 | Miller et al. | 208/482 |
| 4,542,253 | 9/1985 | Kaplan et al. | 585/650 |
| 4,571,445 | 2/1986 | Slaugh | 585/852 |
| 4,593,148 | 6/1986 | Johnson et al. | 585/823 |
| 4,695,366 | 9/1987 | Miller et al. | 208/91 |
| 4,741,819 | 5/1988 | Robinson et al. | 208/65 |
| 4,764,268 | 8/1988 | Lane | 208/113 |
| 4,788,364 | 11/1988 | Harandi | 585/312 |
| 4,831,206 | 5/1989 | Zarchy | 208/91 |
| 4,831,207 | 5/1989 | O'Keef et al. | 208/91 |
| 4,849,025 | 7/1989 | Bain et al. | 134/22.1 |
| 4,855,269 | 8/1989 | Mohr | 502/37 |
| 4,904,368 | 2/1990 | Turner | 208/48 |
| 4,925,549 | 5/1990 | Robinson et al. | 208/65 |
| 4,978,439 | 12/1990 | Carnell et al. | 208/91 |
| 4,980,045 | 12/1990 | Krishna et al. | 208/91 |

FOREIGN PATENT DOCUMENTS

| | | |
|---|---|---|
| 873004 | 7/1961 | United Kingdom . |
| 86/02629 | 10/1985 | WIPO . |

*Primary Examiner*—Helane Myers
*Attorney, Agent, or Firm*—Burns, Doane, Swecker & Mathis

[57] ABSTRACT

A process is disclosed for removing residual sulfur from a hydrotreated naphtha feedstock. The feedstock is contacted with molecular hydrogen under reforming conditions in the presence of a less sulfur sensitive reforming catalyst to convert trace sulfur compounds to $H_2S$, and to form a first effluent. The first effluent is contacted with a solid sulfur sorbent to remove the $H_2S$ and form a second effluent. The second effluent is then contacted with a highly selective reforming catalyst under severe reforming conditions. Also disclosed is a method using a potassium containing sulfur sorbent made from nitrogen-free potassium compounds.

25 Claims, No Drawings

SULFUR REMOVAL SYSTEMS FOR PROTECTION OF REFORMING CRYSTALS

BACKGROUND OF THE INVENTION

This application is a continuation of Ser. No. 357,297 filed May 26, 1989, now abandoned, which is a continuation-in-part of Ser. No. 166,588, filed Mar. 10, 1988, now U.S. Pat. No. 4,925,549, which was a continuation of Ser. No. 667,505, filed Oct. 31, 1984, now U.S. Pat. No. 4,741,819.

The present invention relates to the removal of sulfur from a hydrocarbon feedstock, particularly the removal of extremely small quantities of thiophene sulfur.

Generally, sulfur occurs in petroleum and syncrude stocks as hydrogen sulfide, organic sulfides, organic disulfides, mercaptans, also known as thiols, and aromatic ring compounds such as thiophene, benzothiophene and related compounds. The sulfur in aromatic sulfur-containing ring compounds will be herein referred to as "thiophene sulfur".

Conventionally, feeds with substantial amounts of sulfur, for example, those with more than 10 ppm sulfur, have been hydrotreated with conventional catalysts under conventional conditions, thereby changing the form of most of the sulfur in the feed to hydrogen sulfide. Then, the hydrogen sulfide has been removed by distillation, stripping or related techniques. Unfortunately, these techniques often leave some traces of sulfur in the feed, including thiophene sulfur, which is the most difficult type to convert.

Such hydrotreated naphtha feeds are frequently used as feeds for catalytic dehydrocyclization, also known as reforming. However, some of the catalysts used in reforming are extremely sulfur sensitive, particularly those that contain zeolitic components. Other catalysts, on the other hand, can tolerate sulfur at the levels found in typical reforming feeds.

One conventional method for removing residual hydrogen sulfide and mercaptan sulfur is the use of sulfur sorbents. See, for example, U.S. Pat. Nos. 4,204,997 and 4,163,706, the contents of which are hereby incorporated by reference. The concentration of sulfur in this form can be reduced to considerably less than 1 ppm by using the appropriate sorbents and conditions, but it has been found to be difficult to remove sulfur to less than 0.1 ppm, or to remove residual thiophene sulfur. See, for example, U.S. Pat. No. 4,179,361 the contents of which is hereby incorporated by reference, and particularly Example 1 of that Patent. Very low space velocities are required, to remove thiophene sulfur, requiring large reaction vessels filled with sorbent. Even with these precautions, traces of thiophene sulfur still can be found.

Therefore, it would be advantageous to provide a process which can remove most sulfur, including thiophene sulfur, from a reforming feedstream.

SUMMARY OF THE INVENTION

Accordingly, this invention provides a method for removing residual sulfur from a hydrotreated naphtha feedstock.

In the first aspect of the invention there is provided a method which comprises:

(a) contacting the feedstock with hydrogen under mild reforming conditions in the presence of a less sulfur sensitive reforming catalyst, to carry out some reforming reactions, convert trace sulfur compounds to $H_2S$, and form a first effluent;

(b) contacting the first effluent with a solid sulfur sorbent, to remove the $H_2S$, and form a second effluent which is less than 0.1 ppm sulfur; and (c) contacting the second effluent with a highly selective reforming catalyst which is more sulfur sensitive than the catalyst used in step (a) under severe reforming conditions.

In another aspect of the invention there is provided a method which may be used alone or in combination with other aspects of the invention for removing sulfur from a reforming feedstream using a potassium containing sulfur sorbent which is made with a potassium compound, preferably one not containing nitrate or other nitrogen compounds to avoid the unnecessary generation of ammonia and water during startup operation. Preferably this sorbent is alumina impregnated with potassium carbonate.

In even another aspect of the invention there are provided other methods for removing or controlling the production of unwanted sulfur and water in reforming processes, which can be used, for example, in combination with the other aspects of the invention.

DETAILED DESCRIPTION OF THE PREFERRED EMBODIMENTS

The naphtha fraction of crude distillate, containing low molecular weight sulfur-containing impurities such as mercaptans, thiophene, and the like, is usually subjected to a preliminary hydrodesulfurization treatment. The effluent from this treatment is subjected to distillation-like processes to remove $H_2S$. The effluent from the distillation step will typically contain between 0.2 and 5 ppm sulfur, and between 0.1 and 2 ppm thiophene sulfur. These amounts of sulfur can poison selective sulfur sensitive reforming catalysts in a short period of time.

Therefore, the resulting product stream, which is the feedstream to the reforming step, is contacted with a highly efficient sulfur sorbent before being contacted with the sensitive reforming catalyst. Contacting this stream with a conventional sulfur sorbent removes most of the easily removed $H_2S$ sulfur and most of the mercaptans, but tends to leave unconverted thiophene sulfur. Sulfur sorbents that effectively remove thiophene sulfur require low space velocities; for example, liquid hourly space velocities of less than 1 $hr.^{-1}$ have been reported in actual examples.

The less sensitive reforming catalyst (hereinafter the "first" reforming catalyst) is a Group VIII metal and a promoter metal, if desired, supported on a refractory inorganic oxide metal. Suitable refractory inorganic oxide-supports include alumina, silica, titania, magnesia, boria, and the like and combinations such as silica and alumina or naturally occurring oxide mixtures such as clays. The preferred Group VIII metal is platinum. Also, a promoter metal such as rhenium, tin, germanium, iridium, rhodium, or ruthenium, may be present. Preferably, the less sulfur sensitive reforming catalyst comprises platinum and a promoter metal such as rhenium if desired, or an alumina support, and the accompanying chloride. Such a reforming catalyst is discussed fully in U.S. Pat. No. 3,415,737, the contents of which is hereby incorporated by reference.

The hydrocarbon conversion with the first reforming catalyst is carried out in the presence of hydrogen at a pressure adjusted to thermodynamically favor dehydrogenation and limit undesirable hydrocracking by kinetic means. The pressures which may be used vary from 15 psig to 500 psig, and are preferably between from about 50 psig to about 300 psig; the molar ratio of hydrogen to hydrocarbons preferably being from 1:1 to 10:1, more preferably from 2:1 to 6:1.

The sulfur conversion reaction occurs with acceptable speed and selectivity at a temperature ranging from 300° C. to 500° C. Therefore, the reactor containing the first reforming catalyst is preferably operated at a temperature ranging from between about 300° C. and 480° C. These are known as "mild" reforming conditions.

When the operating temperature of the reactor containing the first reforming catalyst is more than about 300° C., the sulfur conversion reaction speed is sufficient to accomplish the desired reactions. At higher temperatures, such as 400° C. or more, the reforming reactions, particularly dehydrogenation of naphthenes, begin to accompany the sulfur conversion. Such reforming reactions are endothermic and may result in a temperature drop of 10° to 50° C. as the stream passes through this first reactor. When the operating temperature of this first reactor is above about 480° C., an unnecessarily large amount of reforming takes place which is accompanied by hydrocracking and coking. In order to minimize the undesirable side reactions, the reactor temperature should be not more than about 480° C., or preferably, 450° C. The liquid hourly space velocity of the hydrocarbons in this first reforming reactor reaction is preferably between 3 and 15.

Reforming catalysts have varying sensitivities to sulfur in the feedstream. Some reforming catalysts are less sensitive and do not show a substantially reduced activity if the sulfur level is kept below about 5 ppm. When the catalysts are deactivated by sulfur and coke buildup they can normally be regenerated by burning off the sulfur and coke deposits. Preferably, the first, less sensitive, reforming catalyst is of this type.

The effluent from the reforming step with the first reforming catalyst (hereinafter the "first effluent"), is then contacted with a sulfur sorbent. This sulfur sorbent must be capable of removing the $H_2S$ from the first effluent to less than 0.1 ppm at all reforming temperatures, about 300° to 450° C. Several sulfur sorbents can work well at these temperatures. The sorbent reduces the amount of sulfur in the feedstream to amounts less than 0.1 ppm, to produce what will hereinafter be referred to as the "second effluent".

The sulfur sorbent used in this invention contains a metal that readily reacts to form a metal sulfide supported by a refractory inorganic oxide or carbon support. Preferable metals include zinc, molybdenum, cobalt, tungsten, potassium, sodium, calcium, barium, and the like. The support preferred for these metals are refractory inorganic oxides, such as alumina, silica, boria, magnesia, titania, and the like. In addition, zinc can be supported on fibrous magnesium silicate clays, such as attapulgite, sepiolite, and palygorskite. A particularly preferred support is one of attapulgite clay with about 5 to 30 weight percent binder oxide added for increased crush strength. The binder oxides can include refractory inorganic oxides, such as alumina, silica, titania and magnesia.

One preferred sulfur sorbent of this invention will be a support containing between 5 and 40, preferably 10 and 30 weight percent of the metal. The metal can be placed on the support by any conventional manner, such as impregnation. But the preferred method is to mull a metal-containing compound with the support to form an extrudable paste. The paste is extruded and the extrudate dried and calcined. Typical metal compounds that can be added are the metal carbonates which decompose to form the oxide upon calcining.

In another embodiment, more than one sulfur sorbent is used. In this embodiment, a first sulfur sorbent, such as zinc or zinc oxide on a carrier, is used to produce a sulfur-lean effluent. Then a second sulfur sorbent, such as a metal compound of Group IA or Group IIA metal is used to reduce the hydrogen sulfide level of the effluent to below 50 ppb. The effluent is then contacted with the highly selective reforming catalyst described below.

As noted above, one aspect of the invention generally involves the use of a potassium containing sulfur sorbent which is prepared using potassium not containing nitrate or other nitrogen containing compounds. Preferably, it involves the use of a sulfur sorbent made by impregnating alumina with potassium carbonate. When this aspect of the invention is combined with the first aspect of the invention (or for that matter, any method wherein it is desirable to use a sorbent to remove sulfur from a feedstream), particularly beneficial results can be obtained. That is, the unwanted generation of water and ammonia, which can be harmful, particularly to certain catalysts such as zeolite-type catalysts, can be avoided.

Such a potassium containing sulfur sorbent removes the $H_2S$ from the process stream by reaction according, for example, to the following mechanisms:

$$2KOH + H_2S \rightarrow K_2S + 2H_2O \quad (1); \text{ and}$$

$$K_2O + H_2S \rightarrow K_2S + H_2O \quad (2).$$

The equilibrium is particularly good for potassium such that $H_2S$ may be quantitatively removed from a process stream of hydrocarbon and $H_2$, especially at a temperature of 250° to 500° C.

The calculated equilibrium values for reaction (1) above are set forth in the Table below. These values were calculated based on operation at 150 psig and 20ppm $H_2O$.

TABLE

| Temperature | K | G (Kal/mol | $[H_2S]$ (ppm) |
|---|---|---|---|
| 500° F. (260° C.) | $6 \times 10^9$ | −23.8 | $0.7 \times 10^{-12}$ |
| 700° F. (371° C.) | $1.2 \times 10^9$ | −26.7 | $4 \times 10^{-12}$ |
| 500° F. (260° C.) | $0.4 \times 10^9$ | −29.6 | $11 \times 10^{-12}$ |

Although sulfur sorbents made by impregnation of alumina with potassium nitrate work very well for sulfur removal, even after calcining at 480°–510° C., such sorbents will typically contain about 2.0 wt % nitrogen. The nitrogen is then presumably reduced by reaction with $H_2$ during the plant startup to generate ammonia and $H_2O$. Ammonia and $H_2O$ have been found to be harmful to zeolite type catalysts during operation. For example, it is generally believed that high levels of water accelerate catalyst fouling.

Therefore, this aspect of the invention involves a potassium sulfur sorbent made by impregnating, preferably alumina, with a solution containing a potassium compound, which does not contain nitrate or other nitrogen containing compounds, preferably potassium carbonate. Nitrogen-free potassium compounds such as potassium carbonate are sufficiently soluble in water (e.g., 10 to 105 gms/100 cc) to make sorbents by a simple impregnation method. The amount of the potassium compound used is calculated to make the sorbent with a desired potassium content on the calcined sorbent (e.g., 5–40 weight percent). When the sorbent is dried and calcined the carbonate decomposes according to the mechanism:

$$K_2CO_3 \rightarrow K_2O + CO_2 \text{ (300°–510° C.)}$$

Any small amount of carbonate remaining in the sorbent can be reduced with $H_2$ in the plant start up according to the mechanism:

$$K_2CO_3 + H_2 = K_2OH + CO \text{ (300°–425° C.)}$$

without evolving water. While carbon monoxide also could be harmful to a platinum containing catalyst, e.g., a Zeolite-type catalyst, carbon monoxide gas can be easily swept out of the system using normal purging procedures, possibly before loading the platinum zeolite catalyst.

Although potassium carbonate is preferred, other non-nitrogen containing potassium compounds are likely candidates for making the nitrogen-free potassium containing sorbent. In selecting such a compound the pertinent considerations should be its availability, solubility in water, temperature of decomposition during calcination, generation of no harmful residue during startup or operation and reasonable cost. Other suitable potassium compounds include potassium chloride, bromide, acetate, formate, bicarbonate, oxalate, phosphate, etc. Of course, potassium compounds which contain sulfur should not be used because of the necessity to exclude sulfur compounds from the overall reactor system. This would make compounds such as potassium sulfate, sulfite, etc. unacceptable.

The effluent from the sulfur sorber, which is the vessel containing the sulfur sorbent, hereinafter the second effluent, will contain less than 0.1 ppm sulfur and preferably less than 0.05 ppm sulfur. The sulfur levels can be maintained as low as 0.05 ppm for long periods of time. Since both the less sulfur sensitive reforming catalyst and the solid sulfur sorbent can be substantially the same size, a possible and preferred embodiment of this invention is that the less sulfur sensitive reforming catalyst and the solid sulfur sorbent are layered in the same reactor. By this method the thiophene sulfur can be converted to hydrogen sulfide and removed in a single process unit.

The second effluent can be contacted with a more selective and more sulfur sensitive reforming catalyst at higher temperatures typical of reforming units. The paraffinic components of the feedstock are cyclized and aromatized while in contact with this more selective reforming catalyst. The removal of sulfur from the feed stream in the first two steps of the process of this invention make it possible to obtain a much longer life than is possible without sulfur protection.

The more selective reforming catalyst of this invention is preferably a large-pore zeolite charged with one or more dehydrogenating constituents. The term "large-pore zeolite" is defined as a zeolite having an effective pore diameter of 6 to 15 Angstroms.

Among the large-pore crystalline zeolites which have been found to be useful in the practice of the present invention, type L zeolite, zeolite X, zeolite Y and faujasite have been found to be the most effective and have apparent pore sizes on the order to 7 to 9 Angstroms.

The composition of type L zeolite, expressed in terms of mole ratios of oxides, may be represented by the following formula:

$$(0.9\text{–}1.3)M_{2/n}O:AL_2O_3(5.2\text{–}6.9)SiO_2:yH_2O$$

In the above formula M represents a cation, n represents the valence of M, and y may be any value from 0 to about 9. Zeolite L, its X-ray diffraction pattern, its properties, and method for its preparation are described in detail in, for example, U.S. Pat. No. 3,216,789, the contents of which is hereby incorporated by reference. The actual formula may vary without changing the crystalline structure for example, the mole ratio of silicon to aluminum (Si/Al) may vary from 1.0 to 3.5.

The chemical formula for zeolite Y expressed in terms of mole ratios of oxides may be written as:

$$(0.7\text{–}1.1)Na_2O:Al_2O_3:xSiO_2:yH_2O$$

In the above formula, x is a value greater than 3 and up to about 6. Y may be a value up to about 9. Zeolite Y has a characteristic X-ray powder diffraction pattern which may be employed with the above formula for identification. Zeolite Y is described in more detail in U.S. Pat. No. 3,130,007, the contents of which is hereby incorporated by reference.

Zeolite X is a synthetic crystalline zeolitic molecular sieve which may be represented by the formula:

$$(0.7\text{–}1.1)M_{2/n}O:Al_2O_3:(2.0\text{–}3.0)SiO_2:yH_2O$$

In the above formula, M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244, the contents of which is hereby incorporated by reference.

It is preferred that the more sulfur sensitive reforming catalyst used in this invention is a type L zeolite charged with one or more dehydrogenating constituents.

Another preferred embodiment of the present invention involves the use of an alkaline earth metal in the large-pore zeolite. That alkaline earth metal may be either barium, strontium or calcium, preferably barium. The alkaline earth metal can be incorporated into the zeolite by synthesis, impregnation or ion exchange. Barium is preferred to the other alkaline earths because it results in a somewhat less acidic catalyst. Strong acidity is undesirable in the catalyst because it promotes cracking, resulting in lower selectivity.

In even another embodiment, at least part of the alkali metal is exchanged with barium using known techniques for ion exchange of zeolites. This involves contacting the zeolite with a solution containing excess $Ba^{++}$ ions. In this embodiment the barium should preferably constitute from 0.1% to 35% by weight of the zeolite.

The large-pore zeolitic dehydrocyclization catalysts according to the invention are charged with one or more Group VIII metals, e.g., nickel, ruthenium, rhodium, palladium, iridium or platinum. The preferred Group VIII metals are iridium and particularly platinum. These are more selective with regard to dehydrocyclization and are also more stable under the dehydrocyclization reaction conditions than other Group VIII metals. If used, the preferred percentage of platinum in the dehydrocyclization catalyst is between 0.1% and 5%.

Group VIII metals are introduced into the large-pore zeolite by synthesis, impregnation or exchange in an aqueous solution of appropriate salt. When it is desired to introduce two Group VIII metals into the zeolite, the operation may be carried out simultaneously or sequentially.

As noted above, another aspect of the invention involves providing other methods for removing sulfur and water from the reforming operation, which can be used, for example, in combination with the other aspects of the invention. Therefore, provided is a method of ensuring that sulfur containing compounds are removed, or reduced to a level that can then be removed by on-line sulfur sorber (e.g. $<100$ ppb), from process plant equipment prior to startup.

This development results from the observation that sulfur compounds are prevalent throughout the process unit. These sulfur compounds typically form an iron sulfide scale (troilite) which remains throughout the plant process equipment. For example, iron sulfide is present in reactors, furnace tubes, heat exchangers, etc. Unless removed, these sulfur compounds (e.g. FeS) will be converted to more mobile sulfur compounds such as $H_2S$, during plant operation.

Accordingly, this technique for removing sulfur involves a method which comprises the steps of:

a) decoking the process equipment;

b) contacting the process equipment with a solvent (e.g., and acid) that dissolves iron sulfide (e.g. HCl at pH=2) and then water to clean the metal surfaces of the equipment; and c) reacting any residual sulfur compounds in the equipment with hydrogen at temperatures at least as high as those planned for plant use (e.g., 950° to 1000° F. some Zeolite catalysts) and trapping the resulting hydrogen sulfide with a sulfur sorbent such as potassium on alumina). Preferably, an effective sorbent is placed in each reactor so that sulfur would not have to move from reactor to reactor increasing the possibility of deposition on various surfaces of equipment therebetween. Optionally, after steps (a) and (b) a physical cleaning step, such as sand blasting or grit circulation, is used.

Preferably the decoking step (a) includes both a steam/air decoking of the furnace tubes and a caustic wash (degreasing) of all the equipment surfaces. These procedures help expose sulfur compounds for the subsequent steps. It is also preferred to operate cleanup step (b) in both forward and reverse flow directions, so that there is good contact between all equipment surfaces and the acid. This will help prevent certain problems such as the formation of air pockets which may leave "dirty" areas after treatment. U.S. Pat. Nos. 4,289,639, 4,276,185, and 3,732,123, the contents of which are incorporated by reference, describe processes for steam-air decoking and chemically cleaning process equipment.

After step (c) the sulfur sorbent can be replaced with clean sulfur sorbent to ensure maximum operating life for the sulfur sorbent chemicals. Also, it has been discovered that cleaned metal surfaces will compete with the sulfur sorber for $H_2S$. Thus, exposure of the cleaned surfaces from step (b) to $H_2S$, which is generated in step (c), should be minimized. This can be accomplished, for example, by filling the cleaned vessels with sulfur sorbent or by bypassing vessels already cleaned to a sulfur-free extent.

As for other methods for controlling the generation of unwanted water, another embodiment of the invention involves the use of a non-aqueous heat exchange fluid in the reforming process. In catalytic reforming plants the product is typically cooled by being heat exchanged with the feed to bring the temperature of the product stream down to around 200° F. Then the product is often further cooled in another heat exchanger which uses water to remove heat from the product stream before the product stream flows into a product separator. According to this embodiment of the invention, a non-aqueous heat transfer substance such as propane or a propane-butane mixture, is used in this second heat exchanger rather than water.

In most reforming processes, gas from the product separator is recycled and introduced into the feed. If prior to introduction into the product separator, the product stream is introduced into a heat exchanger using water as the heat exchange medium, there is a great risk of the product stream contacting the water e.g., from cracks in the heat exchanger tubes. Water would then be passed into the product stream and ultimately recycled back to the feed through the recycle gas increasing the amount of water in the system. By utilizing a non-aqueous heat exchange fluid, the adverse effects relating to water in the system, particularly with respect to water sensitive catalysts such as Zeolite catalysts used in reforming, can be further minimized.

There are a number of additional methods which can be used to control water levels during startup, reduction and operation. For example, exposure of the catalyst to humid atmospheres can be minimized prior to loading which will limit the initial water content of the catalyst.

The following detailed Examples are presented as specific illustrations of certain embodiments of the invention. It should be understood, however, that the invention is not limited to the specific details set forth in the Examples.

EXAMPLE 1

To exemplify the present invention, a feedstock containing measured amounts of various impurities was passed over a reforming catalyst and then a sulfur sorbent. The less sensitive reforming catalyst was made by the method described in U.S. Pat. 3,415,737.

The sulfur sorbent was prepared by mixing 150 grams alumina with 450 grams attapulgite clay, adding 800 grams zinc carbonate, and mixing the dry powders together. Enough water was added to the mixture to make a mixable paste which was then extruded. The resulting extrudate was dried and calcined.

The sulfur sorbent had the following properties:

| | |
|---|---|
| Bulk density | 0.70 gm/cc |
| Pore volume | 0.60 cc/gm |
| $N_2$ surface area | 86 $m^2$/gm; and |
| Crush strength | 1.5 lbs/mm. |

The final catalyst contained approximately 40 wt. % zinc as metal.

A reformer feed was first contacted with the less sensitive reforming catalyst and then with the sulfur sorber. Thiophene was added to a sulfur free feed to bring the sulfur level to about 10 ppm. The product from the sulfur sorber was analyzed for sulfur. If the level was below 0.1 ppm it could have been used as feed for a more sulfur sensitive reforming catalyst. The results are set forth below in Table I.

TABLE I

| Day | Feed Sulfur (ppm) | 1st Reactor Temperature °F. | 2nd Reactor Temperature °F. | Sulfur (ppm) Analysis |
|---|---|---|---|---|
| 1–7 | 11.7 | 850 (454° C.) | 650 (343° C.) | 0.05 |
| 7–9 | 7.2 | 850 (454° C.) | 650 (343° C.) | <0.04 |
| 9–12 | 8.0 | 850 (454° C.) | 650 (343° C.) | <0.05 |
| 13 | 10.5 | 850 (454° C.) | 650 (343° C.) | 0.06 |
| 14–15 | 10.5 | 850 (454° C.) | 700 (370° C.) | |
| 16 | 10.5 | 800 (425° C.) | 700 (370° C.) | 0.04 |
| 2017–19 | 10.5 | 750 (400° C.) | 700 (370° C.) | 0.04 |
| 20–21 | 10.5 | 700 (370° C.) | 700 (370° C.) | |
| 22–23 | 8.6 | 700 (370° C.) | 700 (370° C.) | <0.04 |
| 24–28 | 8.4 | 700 (370° C.) | 700 (370° C.) | <0.04 |

EXAMPLE 2

A small hydroprocessing reactor was set up containing 25 cubic centimeters of a mixture of platinum on alumina as the less sensitive reforming catalyst, and zinc oxide on alumina as the sulfur sorbent. The effluent from this reactor was passed over 100 cc of L zeolite that had been barium exchanged, which is a highly selective, but a very sulfur sensitive reforming catalyst. The feedstock was a light naphtha feedstock. The results are shown in Table II. One ppm sulfur was added to the feed at 300 hours. The temperature was increased to provide a total for $C_5$ yield of 88.5 volume percent.

TABLE II

| Hours of Operation | Temperature °F. |
|---|---|
| 200 | 855 |
| 400 | 860 |
| 600 | 860 |
| 800 | 870 |
| 1000 | 875 |
| 1200 | 875 |

On the other hand, when the same L zeolite reforming catalyst was used in the presence of sulfur, it was rapidly deactivated. The temperature was to be adjusted upwards to maintain a constant $C_5$+ make, but 0.5 ppm sulfur was added at 270 to 360 hours on stream, and no sulfur protection was present. The reforming catalyst deactivated so rapidly that after 450 hours it was no longer possible to maintain a constant $C_5$+ make. The results are shown in Table III.

TABLE III

| Run time, Hrs. | For 50 wt % Aromatics in Liquid Temperature °F. | $C_5$+ Yield LV % |
|---|---|---|
| 200 | 862 | 84.2 |
| 300 | 864 | 85.0 |
| 350 | 876 | 85.6 |
| 400 | 887 | 85.6 |
| 450 | 896 | 85.5 |
| 500 | 904 | 85.8 |

The above comparison shows how the present invention effectively protects the more sulfur sensitive catalyst, thus adding greatly to its life.

EXAMPLE 3

A platinum on alumina reforming catalyst was made by impregnating high purity alumina base (1/16" dia. extrudate) with a solution of chloroplatinic and hydrochloric acids. For 100 gms of alumina base, a solution was used composed of 2.2 mls of a standard solution of chloroplatinic acid plus 13.7 mls of concentrated hydrochloric acid diluted to 85 mls with distilled water. The alumina base was impregnated with this solution, allowed to soak a few hours and then dried at 120° C. and calcined at 343° C. and 510° C. for 2 hours in air. The final catalyst contained 0.2 wt % Pt and 0.8 wt % chloride.

EXAMPLE 4

A sulfur sorbent was made by impregnating alumina base (1/16" extrudate) with a solution containing potassium nitrate. Other potassium compounds such as potassium bicarbonate, carbonate, acetate etc. could also be used. The amount of base used was 200 gms to which was added a solution containing 58.8 gms of $KNO_3$ diluted to 162 mls with distilled water. The base was impregnated, allowed to soak, dried at 120° C. and then calcined at 243° C. and 510° C. for 2 hours in air. The final sorbent contained 10.6 wt % potassium.

EXAMPLE 5

A sulfur sorbent was made by impregnating alumina base (1/16" extrudate) with a solution containing potassium carbonate. The amount of base used was 100 gms to which was added a solution containing 17.7 gms of $K_2CO_3$ diluted to 78 mls with distilled water. The base was impregnated, allowed to soak, dried at 120° C. and then calcined at 243° C. and 510° C. for 2 hours in air. The final sorbent contained 10.5 wt % potassium.

EXAMPLE 6

A pilot plant test was made using (a) the $Pt/Al_2O_3$ sulfur conversion catalyst prepared in Example 3, (b) the $K/Al_2O_3$ sulfur sorbent as described in Example 4, and (c) a Pt/Ba exchanged L-Zeolite reforming catalyst. A summary of the characteristics of the particular materials used in this test is set forth below:

| Description | (a) Sulfur Conversion Catalyst | (b) Sulfur Sorbent | (c) Ba Exchanged L-Zeolite Reforming Catalyst |
|---|---|---|---|
| Composition | $Pt/Al_2O_3$ | $K/Al_2O_3$ | Pt/L-Zeolite + $Al_2O_3$ |
| Metal Content | 0.2 wt % | 10.6 wt % | 0.64 wt % |
| Volume, cc | 15 | 30 | 100 |
| Weight, gms | 9.2 | 21.4 | 83.9 |
| WHSV, $hr^{-1}$ | 12.9 | 5.5 | 1.4 |
| Cat temperature | 700° F. | 700° F. | 860–950° F. |

A $C_6$–$C_8$ naphtha feed was used for this test and controlled to an R.I. (refractive index) target to achieve constant conversion to aromatics. The temperature of the L-Zeolite bed was controlled through the test to maintain constant R.I. The results are set forth in Table IV below.

TABLE IV

| Run Hrs | S in Feed ppm | Cat Avg Temp, °F. | C5+ Yield LV % |
|---|---|---|---|
| 50 | <0.1 | 866 | 88.7 |
| 100 | <0.1 | 869 | 89.0 |
| 150 | <0.1 | 871 | 89.1 |
| 200 | <0.1 | 874 | 89.1 |
| 250 | <0.1 | 876 | 89.2 |
| 300 | <0.1 | 879 | 89.2 |

Sulfur Injected into feed

TABLE IV-continued

| Run Hrs | S in Feed ppm | Cat Avg Temp, °F. | C5+ Yield LV % |
|---|---|---|---|
| 350 | 1.0 | 881 | 89.3 |
| 400 | 1.0 | 884 | 89.2 |
| 450 | 1.0 | 887 | 89.3 |
| 500 | 2.0 | 890 | 89.3 |
| 550 | 2.0 | 893 | 89.2 |
| 600 | 3.0 | 896 | 89.2 |
| 650 | 3.0 | 899 | 89.2 |
| 700 | 3.0 | 902 | 89.2 |
| 750 | 2.0 | 905 | 89.0 |
| 800 | 2.0 | 908 | 88.9 |
| 850 | 2.0 | 911 | 88.6 |
| 900 | 2.0 | 914 | 88.4 |

The fouling rate was 0.052° F./H during the first 300 hours of the test and 0.060° F./H after sulfur was injected into feed. The above results show that the $C_5+$ yield and the fouling rate also remained nearly constant over the period of time during which sulfur containing feed was used and clean (hydrotreated) feed was used. This demonstrates that the sulfur removal process worked effectively since even trace amounts of sulfur (e.g., 0.1–0.5 ppm) would cause an acceleration of fouling and loss of conversion to aromatics.

EXAMPLE 7

The following test was conducted using a Pt/L-Zeolite catalyst to investigate the sensitivity of the catalyst to higher than normal amounts of water and ammonia in the recycle gas stream. As a standard there was provided a paraffinic naphtha raffinate which was reformed at 150 psig, 1.7 LESV, 3.0 $H_2$/HC to make a product having an 86 Research Octane Number. The $C_5+$ yield obtained with the Pt/L-Zeolite catalyst was 84–85 LV% with a fouling rate of 0.027° F./hour. A low water content of about 5–10 ppm in the recycle gas is normal for reforming under these conditions.

A nitrogen compound (butyl amine) was then added to the standard feed so that the naphtha feed contained 11.7 ppm nitrogen. When this feed was subjected to reforming over the Pt/L-Zeolite catalyst, the $C_5+$ yield was about 84.5 LV%. However, the fouling rate increased to 0.048° F./hour. Thus, when nitrogen was present there was an increase in the fouling rate of about 1.8 times, which would shorten the run cycle to about 55% of that obtained in a clean feed situation.

The procedure was then repeated except that instead of adding nitrogen to the clean feed, an alcohol was added to the clean feed in an amount of 65 ppm by weight oxygen. This produced water during reforming in the presence of the $H_2$ gas and the Pt/L-Zeolite catalyst. In particular, about 200 ppm water was measured in the recycle $H_2$ gas while the alcohol containing feed was being used. As a result, the fouling rate was found to increase from the standard rate of 0.028° F./hour to 0.065° F./hour. Thus, when the alcohol was added to the feed to increase the amount of water present there was an increase in the fouling rate of about 2.3 times, which would shorten the run cycle to about 40% of that obtained in the dry feed situation with low water content (<10ppm) in the recycle gas.

Accordingly, it can be seen from this Example that it is desirable to avoid increased amounts of nitrogen or water during reforming.

The foregoing description of the invention in primary part portrays particular preferred embodiments of the invention in accordance with the requirements of the patent statutes and for purposes of explanation and illustrated. It will be apparent, however, to those skilled in the art, that many modifications and changes in the disclosed methods may be made without departing from the scope and spirit of the invention. For example, the aspects of the invention relating to the potassium containing sulfur sorbent made from potassium compounds which are nitrogen-free and the other methods for removing or controlling sulfur and water may be used alone and need not be used in combination with any or all of the other aspects of the invention. It is applicants' intention in the following claims to cover such modifications and variations as in the true spirit of the invention.

What is claimed is:

1. A method for removing residual sulfur from a naphtha feedstock comprising:

(a) contacting said feedstock with hydrogen under mild reforming conditions in the presence of a first reforming catalyst to carry out some reforming reactions, convert trace sulfur compounds to $H_2S$ and form a first effluent;

(b) contacting said first effluent with a solid sulfur sorbent to remove the $H_2S$, to form a second effluent which contains less than 0.1 ppm sulfur; and (c) contacting said second effluent with a highly selective reforming catalyst.

2. A process according to claim 1, wherein said feedstock contains from 0.2 to 10 ppm sulfur.

3. A process according to claim 1, wherein said feedstock contains from 0.1 to 5 ppm thiophene sulfur.

4. A process according to claim 1, wherein said second effluent contains no more than 0.05 ppm sulfur.

5. A process according to claim 1, wherein said feedstock is contacted with said first reforming catalyst at a liquid hourly space velocity of at least 5 $hr.^{-1}$.

6. A process according to claim 1, wherein said first effluent stream is contacted with said sulfur sorbent at a liquid hourly space velocity of at least 3 $hr.^{-1}$.

7. A process according to claim 1, wherein said first reforming catalyst comprises a Group VIII catalytic metal, disposed on a refractory inorganic oxide.

8. A process according to claim 1, wherein said sulfur sorbent includes a metal selected from the group consisting of zinc, molybdenum, cobalt and tungsten, supported on a refractory inorganic material porous support.

9. A process according to claim 8, wherein said porous support is selected from the group consisting of alumina, silica, titania, magnesia and carbon.

10. A process according to claim 8, wherein said porous support includes attapulgite clay.

11. A process according to claim 8, wherein said porous support contains a binder oxide selected from the group consisting of alumina, silica, titania and magnesia.

12. A process according to claim 1, wherein said sulfur sorbent contains a metal compound and wherein the metal is selected from Group I-A or Group II-A of the periodic table, supported on a refractory inorganic oxide.

13. A process according to claim 12, wherein said metal is selected from the group consisting of sodium, potassium, barium, and calcium.

14. A process according to claim 12, wherein said refractory inorganic oxide is alumina.

15. A process according to claim 14, wherein said metal is potassium.

16. A process according to claim 15, wherein said sorbent has been made by impregnating alumina with potassium carbonate.

17. A process according to claim 16, wherein said sorbent contains from about 5 to about 40 weight percent potassium.

18. A process according to claim 1 wherein said sulfur sorbent of step (b) and said catalyst of step (c) are present in the same reaction vessel.

19. A process according to claim 1 wherein said first reforming catalyst and said solid sulfur sorbent are contained in the same reaction vessel.

20. A reforming process where unwanted ammonia is minimized, said process comprising contacting a sulfur containing naphtha feedstock stream with a sulfur sorbent and then contacting said feedstock stream with a reforming catalyst, said sulfur sorbent including potassium supported on a refractory inorganic material porous support prepared from potassium compounds which are nitrogen-free.

21. A process according to claim 20 wherein said porous support contains alumina.

22. A process according to claim 21 wherein said sorbent is prepared by impregnating alumina with potassium carbonate.

23. A process according to claim 22, said sorbent containing from about 5 to about 40 weight percent potassium.

24. A process according to claim 20 further comprising contacting the feed with a reforming catalyst, wherein said reforming catalyst and said solid sulfur sorbent are contained in the same reaction vessel, and the feed contacts the substantially all of the sorbent before contacting the catalyst.

25. In a reforming process comprising the steps of (i) contacting a hydrocarbon feed with a reforming catalyst and producing a product stream, (ii) introducing the product stream into a product separator, and (iii) recycling gas from the product separator to the feed, wherein the product stream is cooled prior to introduction into the product separator by passing the product stream through a heat exchanger, minimizing unwanted water by using a non-aqueous heat exchange fluid in said heat exchanger for cooling the product stream prior to introduction of the product stream into the product separator.

* * * * *